US009673006B2

(12) United States Patent
Hermosillo et al.

(10) Patent No.: US 9,673,006 B2
(45) Date of Patent: Jun. 6, 2017

(54) EXHAUST DIFFUSER FOR A GAS-INSULATED HIGH VOLTAGE CIRCUIT BREAKER

(71) Applicant: ALSTOM Technology Ltd, Baden-Suisse (CH)

(72) Inventors: Victor F. Hermosillo, Bethel Park, PA (US); James M. Main, West Alexander, PA (US); Steven Grosick, Stockdale, PA (US); Andrew Chovanec, Blairsville, PA (US)

(73) Assignee: ALSTOM TECHNOLOGY LTD, Baden-Suisse (CH)

( * ) Notice: Subject to any disclaimer, the term of this patent is extended or adjusted under 35 U.S.C. 154(b) by 0 days.

(21) Appl. No.: 14/603,863

(22) Filed: Jan. 23, 2015

(65) Prior Publication Data

US 2016/0217952 A1 Jul. 28, 2016

(51) Int. Cl.

| | |
|---|---|
| ***H01H 33/74*** | (2006.01) |
| ***H01H 33/56*** | (2006.01) |
| ***H01H 33/88*** | (2006.01) |

(52) U.S. Cl.

CPC ..... *H01H 33/74* (2013.01); *H01H 33/56* (2013.01); *H01H 2033/888* (2013.01)

(58) Field of Classification Search

CPC ..... H01H 33/56; H01H 33/74; H01H 33/70; H01H 33/703; H01H 33/7046; H01H 33/7015; H01H 33/98; H01H 33/12; H02G 15/064

USPC ..... 218/46, 48, 51, 52, 56, 57, 97, 59, 157, 218/13

See application file for complete search history.

(56) References Cited

U.S. PATENT DOCUMENTS

| | | | | |
|---|---|---|---|---|
| 7,893,379 | B2 * | 2/2011 | Schoenemann | H01H 33/74 218/157 |
| 2005/0150868 | A1 * | 7/2005 | Nowakowski | H01H 33/7015 218/57 |
| 2007/0068904 | A1 * | 3/2007 | Dahlquist | H01H 33/74 218/59 |

(Continued)

FOREIGN PATENT DOCUMENTS

| | | | |
|---|---|---|---|
| EP | 1806760 | A1 | 7/2007 |
| EP | 1 835520 | A1 | 9/2007 |

(Continued)

*Primary Examiner* — Renee S Luebke
*Assistant Examiner* — William Bolton
(74) *Attorney, Agent, or Firm* — Nixon Peabody, LLP; Khaled Shami

(57) ABSTRACT

A gas exhaust diffuser for a circuit breaker, comprising a first casing extending longitudinally along a principal axis with an open end to allow gas to enter and a closed end, and a second casing coaxial to the first casing, extending along the principal axis, with at least one outlet to allow gas to escape, the closed end of the first casing being arranged in the second casing and the first casing having at least two radial openings near its closed end to provide a fluid communication between the first and second casing. A plurality of incurved elements are positioned radially in the second casing at the at least one radial opening to create a rotation of an entering exhaust flow in a plan perpendicular to the principal axis, thereby generating a substantially helicoidally-shaped exhaust flow path in the second casing.

10 Claims, 2 Drawing Sheets

(56) References Cited

U.S. PATENT DOCUMENTS

| | | | | |
|---|---|---|---|---|
| 2007/0075044 | A1 | 4/2007 | Ye et al. | |
| 2007/0158310 | A1* | 7/2007 | Grieshaber | H01H 33/98 218/13 |
| 2009/0134123 | A1* | 5/2009 | Grieshaber | H01H 33/7015 218/53 |
| 2014/0251957 | A1* | 9/2014 | Cernat | H01H 33/7015 218/51 |

FOREIGN PATENT DOCUMENTS

| | | | |
|---|---|---|---|
| JP | H09231885 | A | 9/1997 |
| JP | 2003217411 | A | 7/2003 |

* cited by examiner

EXHAUST DIFFUSER FOR A GAS-INSULATED HIGH VOLTAGE CIRCUIT BREAKER

TECHNICAL FIELD

The present invention related to the field of gas-insulated high voltage circuit breakers, having a metal outer tank and being either of the gas insulated switchgear (GIS) or of the dead tank type.

More particularly, the invention relates to an exhaust diffuser for a circuit breaker configured to improve the evacuation of hot gases produced during a current-breaking operation by such a circuit breaker.

PRIOR ART

A circuit breaker generally has in a longitudinal enclosure with two ends ("tank") filled with an insulating gas an interrupting chamber extending along a longitudinal axis. The interrupting chamber comprises an arcing volume, two arcing contacts, a blown device (generally an insulating nozzle) for blowing the insulating gas to the arcing volume to extinguish an arc generated during breaking operations by electrical arcing between the two arcing contacts (pin and tulip) and an exhaust diffuser connected to the arcing volume for cooling hot gases generated during the breaking operations. The generated hot gases flow both in the tulip direction and in the pin direction, but actually most of the produced hot gases flow in the pin direction, after the pin exits the arcing volume. That is the reason why the exhaust diffuser is generally placed on the pin side of the interrupting chamber.

In metal clad circuit breakers available commercially at the present time, there are three sorts of exhaust concepts.

A first exhaust concept consists in providing a longitudinal exit of the exhaust gases towards the tank end. An exhaust diffuser based on this concept is for example to be found in Japanese types of circuit breaker, such as the device described in Patent Application JP 2003 217411 or the one described in Patent Application JPH09231885, and it includes a short tube fitted at the outlet of the hot gas blow-out arcing volume of the interrupting chamber, this tube also permitting the gas to be blown directly into the metal outer tank. Dielectric insulation is obtained by keeping long distances between the evacuation crown (constituted by the tube) and the metal outer tank. The disadvantage of this type of exhaust diffusers is they require a long gap between the end of the interrupting chamber and the tank end, which results in a very large metal outer tank.

A second group of exhaust concepts depends on creating a long exhaust path with one or multiple deflections to turn the hot exhaust flow generated by arcing across the contacts. An exhaust diffuser based on this concept is described in the published Patent Application EP 1 806 760, wherein the exhaust path is lengthened as it follows a longitudinal path after the nozzle divergence in the direction of the pin up to a curved contour located at the end of the longitudinal path on the pin side of the interrupter chamber. There, the curved contour deflects and turns the exhaust flow around. After the deflection the exhaust exits to an outer concentric volume. The disadvantage of this type of exhaust diffusers is they require either a very long element, which results in a very large outer tank, or the use of multiple concentric cylindrical elements with turns, which results in an increase of the radial dimensions of the exhaust diffuser and of the circuit breaker tank.

A third group of exhaust concepts depends on constriction of the exhaust flow, the purpose being to contain as much as possible the hot gas inside the enclosure. It allows to slow the stream of hot gases that passes in the exhaust path, thereby cooling the gas stream before it leaves the exhaust diffuser. An example is described in the U.S. Pat. No. 6,646,850, wherein the stream of hot gases is slowed by placing constriction elements along the longitudinal path after the nozzle divergence, these elements including narrowing of the cross-sections, check-valves and flaps, which also serve the purpose of preventing backwards effects from the exhaust gases on the region across the arcing contacts. The disadvantage of slowing the stream of hot gases, in particular by varying the sections through which the stream of hot gases passes in the exhaust path, is that it hinders the attainment of a satisfactory purging of the current breaking gases between the arcing contacts.

Some existing exhaust diffusers combine a lengthening of the exhaust path with the use of constriction elements (Patent EP 1 835 530 and Patent Application US 2007/075044).

Further to the above-cited disadvantages, several of the existing concepts of exhaust diffusers do not make full use of the existing enclosed volume in the exhaust diffuser. The hot gas exhaust flow will generate pockets of trapped gas that does not mix with this exhaust. In several cases, these volumes are located in the rear of the enclosures.

An object of the invention is to provide a gas exhaust diffuser for a gas-insulated high-voltage circuit breaker, which overcomes the above-mentioned disadvantages of the known exhaust diffusers.

DISCLOSURE OF THE INVENTION

To that end, the invention provides a gas exhaust diffuser for a circuit breaker, comprising a first casing extending longitudinally along a principal axis with an open end to allow gas to enter and a closed end, and a second casing coaxial to the first casing, extending along the principal axis, with at least one outlet to allow gas to escape, the closed end of the first casing being arranged in the second casing and the first casing having at least two radial openings near its closed end to provide a fluid communication between the first and second casing, wherein a plurality of incurved elements (preferably blades) are positioned radially in the second casing at the at least one radial opening to create a rotation of an entering exhaust flow in a plan perpendicular to the principal axis, thereby generating a substantially helicoidally-shaped exhaust flow path in the second casing.

In accordance with the invention, it is possible to increase the effectiveness of the exhaust volume coming from the arcing region, in order to redirect, diffuse and mix hot exhaust gases generated by arcing across the contacts of a gas-insulated high-voltage circuit breaker. Actually, the flow of the hot gas coming from the arcing region enters the first casing and follows a longitudinal direction up to the closed end of the first casing, where the flow is deflected and led to the radial openings of the first casing. There, the incurved elements force the hot gas exhaust flow to rotate in the second casing up to the at least one outlet of the second casing. The incurved elements are positioned and configured to induce a component of the flow in the transverse direction to the longitudinal axis of the first casing (which also corresponds to the interrupter chamber longitudinal axis), thereby creating a rotation of the exhaust flow in a plane perpendicular to the longitudinal axis of the first casing in the second casing. This direction of flow improves the mixing of the hot and cold gas present in the gas exhaust diffuser. Together with the positioning of the radial openings near the closed end of the first casing, it further allows for a more effective use of the entire volume available for containment in the gas exhaust diffuser by preventing unused, dead volumes. Furthermore, the rotation of the gas in the second casing will also generate flow in a direction that will not require such a long path for the exhaust to be cooled before it exits to the space between the interrupter chamber and the tank. It thereby allows for a reduction of the length of the gas exhaust diffuser and a more compact gas exhaust diffuser.

Preferably, the first casing is a generally cylindrical shaped casing.

In accordance with an embodiment, a lateral wall of the second casing extending along the principal axis extends away from the open end of the first casing. Preferably, the lateral wall of the second casing may draw near the principal axis as it extends away from the open end of the first casing. A passage cross-section available to the gas flow in the second casing may thereby progressively decrease as the flow draws near the outlet of the second casing.

In accordance with another embodiment, a lateral wall of the second casing extends along the principal axis in a direction of the open end of the first casing, thereby delimiting an annular passage between the first and second casing. Preferably, the second casing may be a generally cylindrical or bell shaped casing.

According to a first variant of this embodiment, the lateral wall of the second casing may end away of a lateral wall of the first casing, thereby forming an annular outlet of the second casing.

According to a second variant of this embodiment, the lateral wall of the second casing may meet a lateral wall of the first casing, thereby closing an end of the annular passage. The at least one outlet of the second casing will then be a side outlet, possibly an annular side outlet.

In accordance with another embodiment, the radial openings of the first casing may be in a same plan perpendicular to the principal axis. Preferably, the radial openings are regularly spaced around the periphery of the first casing.

Preferably, the incurved elements are regularly spaced around a circumference of the first casing. In a preferred embodiment, all the incurved elements are arranged in a clockwise or counter clockwise direction, thereby giving a clockwise or counter clockwise direction to the gas flow.

Another object of the invention is a high-voltage gas-insulated circuit breaker comprising a tank filled with insulating gas and an interrupter chamber, the interrupter chamber being enclosed in the tank and comprising:

an arcing volume;

a pair of arcing contacts, at least one being movable between an open and closed position;

a blown device for blowing the insulating gas to the arcing volume to extinguish an arc produced during a separation of the arcing contacts, thereby forming hot gas; and a gas exhaust diffuser to exhaust said hot gas, wherein said gas exhaust diffuser is a gas exhaust diffuser according to the invention.

An advantage of the present invention is to propose a way of evacuating the hot gases that gives satisfactory cooling while maintaining satisfactory purging of the current-breaking gases between the arcing contacts.

Another advantage of the present invention is to reduce further the overall dimensions of the exhaust diffuser, and also to reduce further the dimensions of the metal outer tank.

A further advantage of the present invention is to optimize the space required for hot exhaust containment in high-voltage circuit breakers.

Additional features and advantages of the present invention are described in, and will be apparent from, the detailed description of the preferred embodiments, the figures and the claims.

DETAILED DESCRIPTION OF PREFERRED EMBODIMENTS OF THE INVENTION

Figure 1:
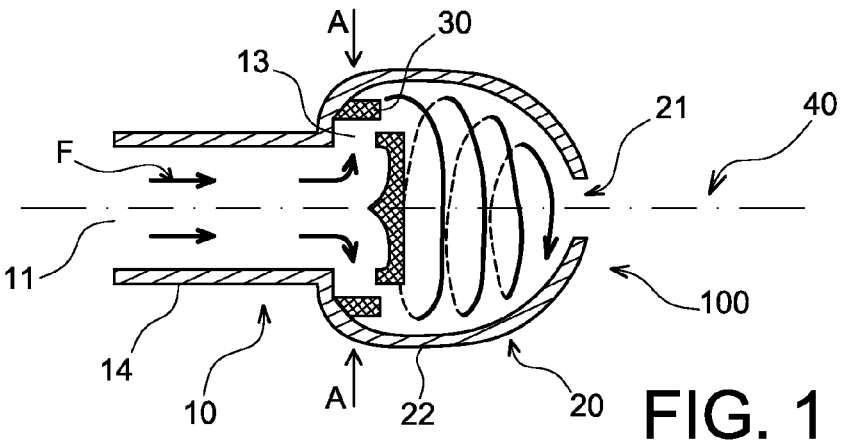
FIG. 1 is a schematic sectional side view of a gas exhaust diffuser of a first embodiment according to the invention.

Now referring to the drawings, wherein like numerals designate like components, FIG. 1 schematically illustrates a gas exhaust diffuser 100 constructed in accordance with the teachings of the invention.

The gas exhaust diffuser 100 includes a first casing 10 extending longitudinally along a principal axis 40, with an open end 11, a closed end 12, a lateral wall 14 extending between the open end 11 and the closed end 12, and radial openings 13 in the side wall 14 near the closed end 12; a second casing 20, extending along the principal axis 40 of the first casing, with a lateral wall 22 and an outlet 21. Incurved elements 30 (for example blades) are positioned at the first casing radial openings 13. The closed end 12 of the first casing has preferably a curved contour configured to deflect and direct the flow towards the radial openings 13.

In the embodiment illustrated in FIG. 1, the lateral wall 22 of the second casing 20 extends away from the open end 11 of the first casing 10 and draws near the principal axis 40 as it extends away from the open end of the first casing. The outlet 21 is centered on the principal axis 40.

Figure 2:
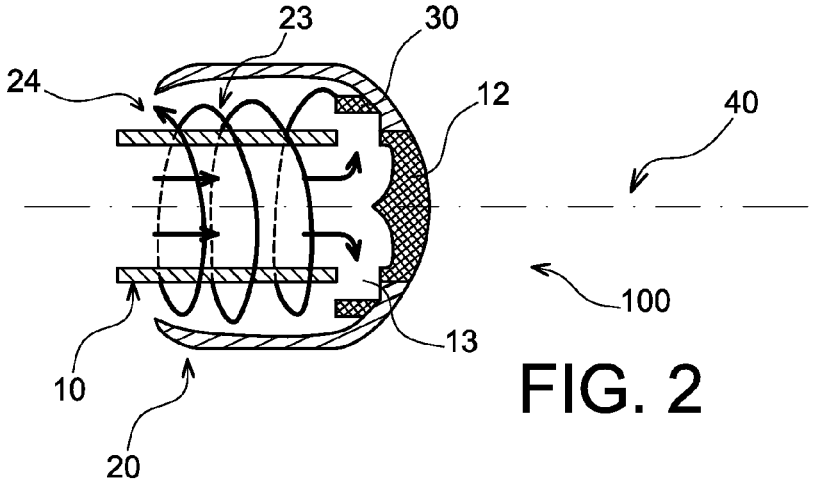
FIG. 2 is a schematic sectional side view of a gas exhaust diffuser of a second embodiment according to the invention.
Figure 3:
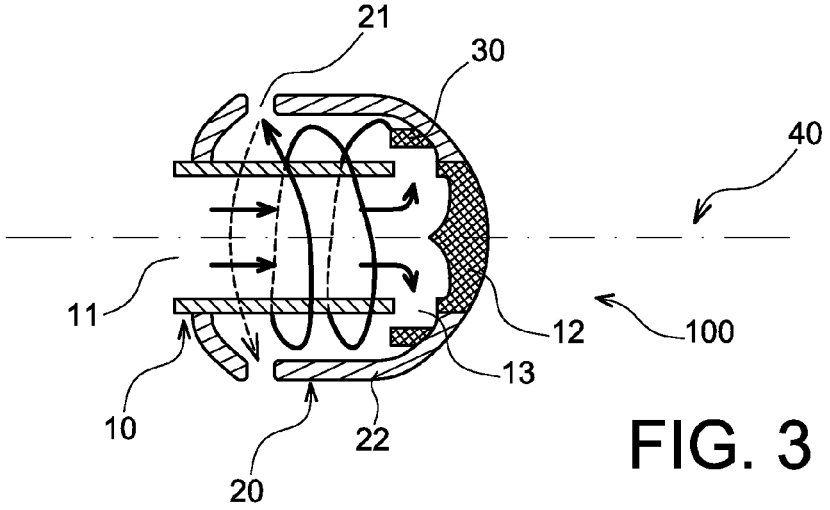
FIG. 3 is a schematic sectional side view of a gas exhaust diffuser of a third embodiment according to the invention.

In the embodiments illustrated in FIG. 2 and FIG. 3, the lateral wall 22 of the second casing 20 extends along the principal axis 40 in a direction of the open end 11 of the first casing 10. The second casing 20 covers the first casing 10, thereby delimiting an annular passage 23 between the wall 14 of the first casing 10 and the wall 22 of the second casing 20.

In the embodiment illustrated in FIG. 2, the lateral wall 22 of the second casing 20 ends to an open end, as the lateral wall 22 ends away of the lateral wall 14 of the first casing 10. The outlet 21 of the second casing 20 is an annular outlet 24 in this embodiment.

In the embodiment illustrated in FIG. 3, the lateral wall 22 of the second casing 20 meets the lateral wall of the first casing 10. In this embodiment, the second casing 20 comprises side outlets, for example two or four outlets.

The embodiments illustrated in FIGS. 1, 2 and 3 allow for three possibilities for the direction of the gas flowing out of the gas exhaust diffuser: a first common exhaust stage in the first casing 10 wherein the gas flow follows a direction parallel to the longitudinal direction of the first casing and a second exhaust stage, wherein the gas flow is helicoidally-shaped and directed towards the tank end of the circuit breaker (in FIG. 1), towards the interrupter gap (in FIG. 2) and radially outwards towards the tank lateral side (in FIG. 3).

In the embodiment of FIG. 1, the direction of gas flow in the second casing is such that the distance between the end of the interrupter chamber and the tank end can be minimized (compared to the prior art exhaust diffusers wherein the exhaust flow is ejected from the exhaust diffusers towards the tank end, for example, in the configurations described in the Patent Application JP 2003 217411 and in the Patent Application JPH09231885), since the exhaust direction is not primarily in the interrupter longitudinal direction.

In the embodiment of FIG. 2, the gas exits from the second casing 20 through an annular outlet 24 on a recessed surface with respect to the wall of the second casing. This recessed area is subjected to lower electric field intensity than those elements of the interrupter chamber with larger radial dimensions. It presents the advantage of using the space between the second casing 20 and the interrupter gap. In addition, the helicoidal direction of the gas flow in the second casing 20 is such that it minimizes the reach of the exhaust gas as it exits the second casing, thereby reducing the required length of the interrupting unit. In other words, in this configuration, the gas flow is forced along a curling path which increases the effectiveness of the exhaust containment volume. In addition, the speed of the flow in the longitudinal direction is reduced. Distance between the outlet and the interrupter gap can consequently be shortened.

In the embodiment of FIG. 3, the gas exhaust is also directed towards the gap between the second casing 20 and the tank. There are two or four outlets radially located near the closed end of the second casing. This configuration presents the advantage of allowing the second casing 20 to extend closer to the interrupter gap and venting radially in the space between the casing 20 and the tank.

In a gas-insulated circuit breaker, hot gases are generated in the arcing area of an interrupter chamber between the arcing contacts and flow in both directions of the arcing contacts, but flow mostly in the pin direction along the direction of the longitudinal axis of the interrupter chamber. That is the reason why the open end of the first casing is to be mounted along the longitudinal axis of the interrupter chamber, so that the hot gas flow pursues its longitudinal path in the first casing 10 (the direction of the flow is symbolized by arrows F) until it is deflected by the closed end 11 of the first casing 10 and directed to the radial openings 13 and the incurved elements 30. The incurved elements, by their configuration (shape) and position, introduce a rotation of the gas flow. This motion is very efficient in pushing the hot gases and mixing them with cold gases pockets in the interrupter chamber of the circuit breaker. When the hot gas is forced to flow in a helicoidal path, a more efficient use of the available containment volume is obtained. This allows for better mixing of the hot exhaust with cool gas and improved cooling without requiring a very long path for the gas flow.

Figure 4A:
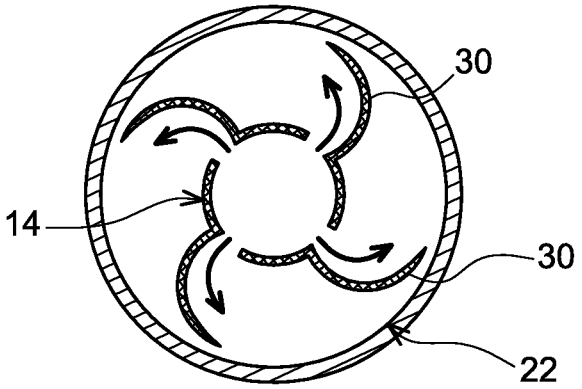
FIGS. 4*a* and 4*b* are examples of schematic sectional side views of the gas exhaust diffuser as taken generally along line A-A of FIG. 1.
Figure 4B:
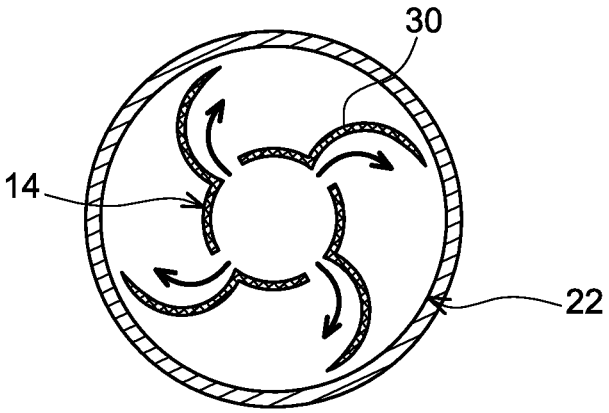

FIG. 4*a* and FIG. 4*b* illustrate two possible configurations for the location of the incurved elements for inducing rotation of the hot gas flow in the second casing. The incurved elements may be placed in a clockwise direction (FIG. 4*a*) to induce a clockwise rotation of the flow, or in a counterclockwise direction to induce a counterclockwise rotation of the flow (FIG. 4*b*).

It will be appreciated by those of ordinary skill in the art that the exemplary gas exhaust diffusers described therein can be embodied in various specific forms without departing from the essential characteristics thereof. The presently disclosed embodiments are considered in all respects to be illustrative and not restrictive. The scope of the invention is indicated by the appended claims, rather than the foregoing description, and all changes that come within the meaning and range of equivalence thereof are intended to be embraced.

LIST OF REFERENCE NUMERALS

10 First casing
11 Open end of the first casing
12 Closed end of the first casing
13 Radial opening of the first casing
14 Lateral wall of the first casing
20 Second casing
21 Outlet of the second casing
22 Lateral wall of the second casing
23 Annular passage of the second casing
24 Annular outlet of the second casing
30 Incurved element
40 Principal axis
100 Gas exhaust diffuser
F Direction of the hot gas flow

The invention claimed is:

1. A gas exhaust diffuser for a circuit breaker, comprising a first casing extending longitudinally along a principal axis with an open end to allow gas to enter and a closed end, and a second casing coaxial to the first casing, extending along the principal axis, with at least one outlet to allow gas to escape, the closed end of the first casing being arranged in the second casing and the first casing having at least two radial openings near its closed end to provide a fluid communication between the first and second casing, wherein the gas exhaust diffuser further comprises a plurality of incurved elements, an incurved element being positioned radially in the second casing at each of the at least two radial openings, the plurality of incurved elements being positioned and configured to create a rotation of an exhaust flow entering in the second casing in a plan perpendicular to the principal axis, thereby generating, in the second casing, an exhaust flow path substantially helicoidal to the principal axis.

2. The gas exhaust diffuser of claim 1, wherein a lateral wall of the second casing extending along the principal axis extends away from the open end of the first casing.

3. The gas exhaust diffuser of claim 2, wherein the lateral wall of the second casing draws near the principal axis as it extends away from the open end of the first casing.

4. The gas exhaust diffuser of claim 1, wherein a lateral wall of the second casing extends along the principal axis in a direction of the open end of the first casing, thereby delimiting an annular passage between the first and second casing.

5. The gas exhaust diffuser of claim 4, wherein the lateral wall of the second casing ends away of a lateral wall of the first casing, thereby forming an annular outlet of the second casing.

6. The gas exhaust diffuser of claim 4, wherein the lateral wall of the second casing meets a lateral wall of the first casing, thereby closing an end of the annular passage.

7. The gas exhaust diffuser of claim 1, wherein the radial openings of the first casing are in a same plan perpendicular to the principal axis.

8. The gas exhaust diffuser of claim 1, wherein the incurved elements are regularly spaced around a circumference of the first casing.

9. The gas exhaust diffuser of claim 1, wherein all the incurved elements are arranged in a clockwise or counter clockwise direction.

10. A high-voltage gas-insulated circuit breaker comprising a tank filled with insulating gas and an interrupter chamber, the interrupter chamber being enclosed in the tank and comprising:

an arcing volume;

a pair of arcing contacts, at least one being movable between an open and closed position;

a blown device for blowing the insulating gas to the arcing volume to extinguish an arc produced during a separation of the arcing contacts, thereby forming hot gas; and a gas exhaust diffuser to exhaust said hot gas, wherein said gas exhaust diffuser includes a first casing extending longitudinally along a principal axis with an open end to allow gas to enter and a closed end, and a second casing coaxial to the first casing, extending along the principal axis, with at least one outlet to allow gas to escape, the closed end of the first casing being arranged in the second casing and the first casing having at least two radial openings near its closed end to provide a fluid communication between the first and second casing, wherein a plurality of incurved elements are positioned radially in the second casing at the at least one radial opening to create a rotation of an entering exhaust flow in a plan perpendicular to the principal axis, thereby generating a substantially helicoidally-shaped exhaust flow path in the second casing.

* * * * *